US011429039B2

(12) United States Patent
Nakamura

(10) Patent No.: US 11,429,039 B2
(45) Date of Patent: Aug. 30, 2022

(54) TONER STORAGE CASE, IMAGE FORMING APPARATUS

(71) Applicant: KYOCERA Document Solutions Inc., Osaka (JP)

(72) Inventor: Yuri Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/373,274

(22) Filed: Jul. 12, 2021

(65) Prior Publication Data

US 2022/0019157 A1 Jan. 20, 2022

(30) Foreign Application Priority Data

Jul. 20, 2020 (JP) ..... JP2020-123757

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
See application file for complete search history.

(56) References Cited

U.S. PATENT DOCUMENTS

2018/0011424 A1* 1/2018 Sasaki ..... G03G 15/0865

FOREIGN PATENT DOCUMENTS

JP 2017201373 A 11/2017

* cited by examiner

*Primary Examiner* — Walter L Lindsay, Jr.
*Assistant Examiner* — Geoffrey T Evans
(74) *Attorney, Agent, or Firm* — Alleman Hall Creasman & Tuttle LLP

(57) ABSTRACT

A toner storage case includes a case main body, a rotary member, a support shaft portion, a bearing portion, and a toner returning portion. The case main body is configured to store toner therein. The rotary member is provided in the case main body and configured to move the toner by being rotated. The support shaft portion rotatably supports the rotary member. The bearing portion includes a bearing hole that rotatably supports the support shaft portion in a state where the support shaft portion is inserted in the bearing hole. The toner returning portion is provided on an outer peripheral surface of the support shaft portion and configured to return the toner that has entered the bearing hole, in an outward direction toward an outside of the bearing hole as the rotary member is rotated.

7 Claims, 8 Drawing Sheets

TONER STORAGE CASE, IMAGE FORMING APPARATUS

INCORPORATION BY REFERENCE

This application is based upon and claims the benefit of priority from the corresponding Japanese Patent Application No. 2020-123757 filed on Jul. 20, 2020, the entire contents of which are incorporated herein by reference.

BACKGROUND

The present disclosure relates to a toner storage case configured to store toner that is used in an image forming apparatus, and relates to an image forming apparatus including the toner storage case.

An image forming apparatus, such as a copier or a printer, that forms an image on a sheet member such as a print sheet by an electrophotographic method, is provided with a developing device (an example of a toner storage case). The developing device stores developer including toner. The developing device develops an electrostatic latent image formed on an image carrier such as a photoconductor drum, by the toner included in the developer. When the toner in the developing device is reduced, the toner is replenished from a toner container.

The developing device and the toner container are each provided with, in their inside, a stirring member and a conveyance member, wherein the stirring member stirs the toner and the conveyance member conveys the toner. The stirring member and the conveyance member are rotatably supported in the developing device and in a housing of the toner case. If the toner enters a gap between a rotary shaft of a rotary member, such as the stirring member or the conveyance member, and a bearing portion, the toner may be fused due to a rotary friction caused by the rotation of the rotary shaft, and the rotary shaft may be stuck. Conventionally, there is known an image forming apparatus configured to discharge, to outside, the toner that has entered the gap between the rotary shaft of the rotary member and the bearing portion.

SUMMARY

A toner storage case according to an aspect of the present disclosure includes a case main body, a rotary member, a support shaft portion, a bearing portion, and a toner returning portion. The case main body is configured to store toner therein. The rotary member is provided in the case main body and configured to move the toner by being rotated. The support shaft portion rotatably supports the rotary member. The bearing portion includes a bearing hole that rotatably supports the support shaft portion in a state where the support shaft portion is inserted in the bearing hole. The toner returning portion is provided on an outer peripheral surface of the support shaft portion and configured to return the toner that has entered the bearing hole, in an outward direction toward an outside of the bearing hole as the rotary member is rotated.

An image forming apparatus according to another aspect of the present disclosure includes the toner storage case and forms an image on a sheet member by using the toner stored in the toner storage case.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
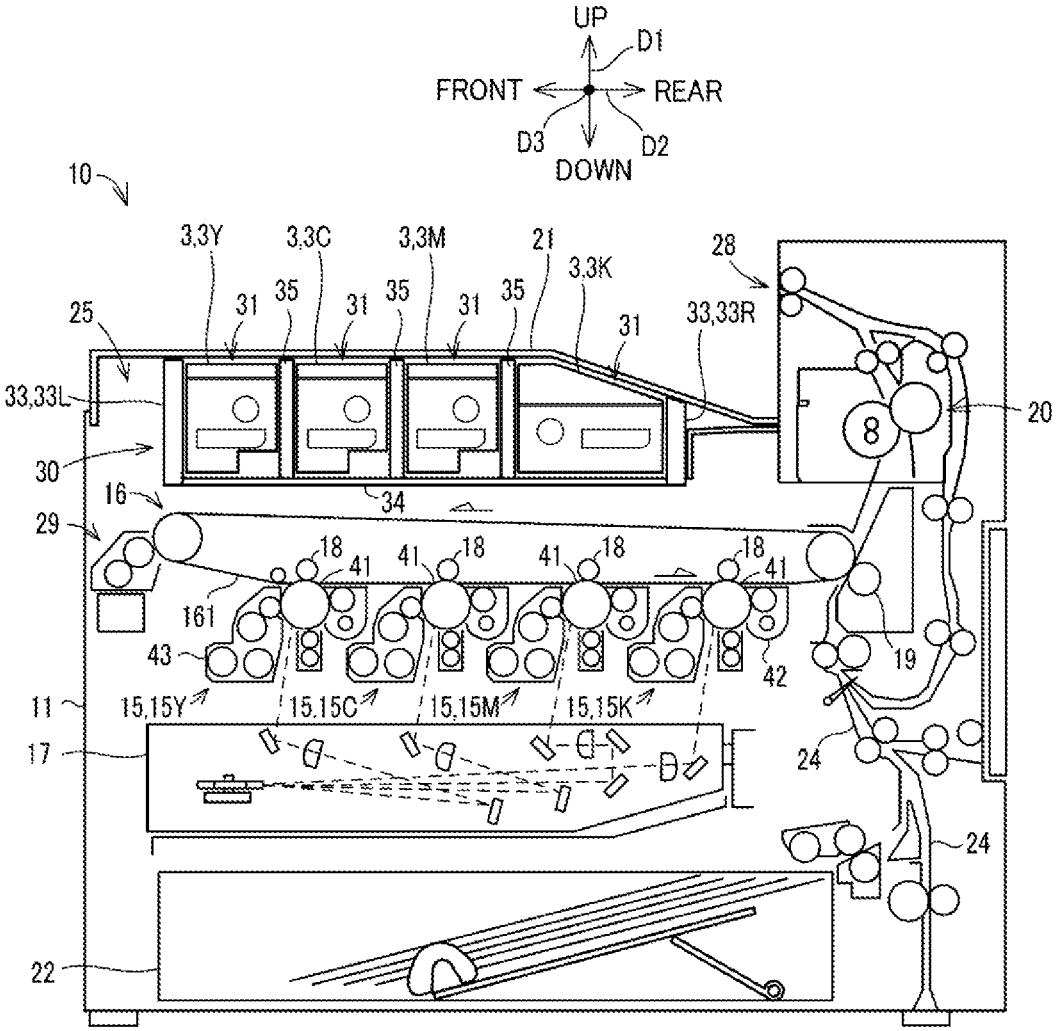
FIG. 1 is a schematic diagram of an image forming apparatus including a toner container according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. In addition, in the following description, an up-down direction D1, a front-rear direction D2, and a left-right direction (or a width direction) D3 that are indicated in the drawings may be used.

[Image Forming Apparatus 10]

FIG. 1 is a diagram showing a configuration of an image forming apparatus 10 according to an embodiment of the present disclosure. As shown in FIG. 1, the image forming apparatus 10 is a multifunction peripheral having a plurality of functions such as a print function, a copy function, a facsimile function, and a scan function. The image forming apparatus 10 is not limited to a multifunction peripheral, only needs to be an apparatus having a print function, and may be, for example, a printer, a copier, or a facsimile apparatus.

The image forming apparatus 10 includes a housing 11. The housing 11 has an approximately parallelepiped shape as a whole. Some of the components constituting the image forming apparatus 10 are stored in the housing 11.

The image forming apparatus 10 includes a plurality of image forming units 15 (15Y, 15C, 15M, and 15K), an intermediate transfer unit 16, a laser scanning unit 17, a primary transfer roller 18, a secondary transfer roller 19, a fixing device 20, a sheet tray 21, a sheet feed cassette 22, a conveyance path 24, a container attachment portion 30, a belt cleaning device 29, and a control portion (not shown) configured to control the components of the image forming apparatus 10. In addition, the image forming apparatus 10 includes a plurality of toner containers 3 (an example of a toner storage case of the present disclosure) attached to the inside of the housing 11 in a detachable manner.

The image forming units 15 perform a process of forming toner images based on an electrophotographic method. The plurality of image forming units 15 are arranged in alignment in the front-rear direction D2. The plurality of image forming units 15 respectively form toner images of corresponding colors on the surfaces of the photoconductor drums 41 and a surface of a transfer belt 161. Specifically, the image forming unit 15Y forms a toner image of yellow, the image forming unit 15C forms a toner image of cyan, the image forming unit 15M forms a toner image of magenta, and the image forming unit 15K forms a toner image of black.

Figure 2:
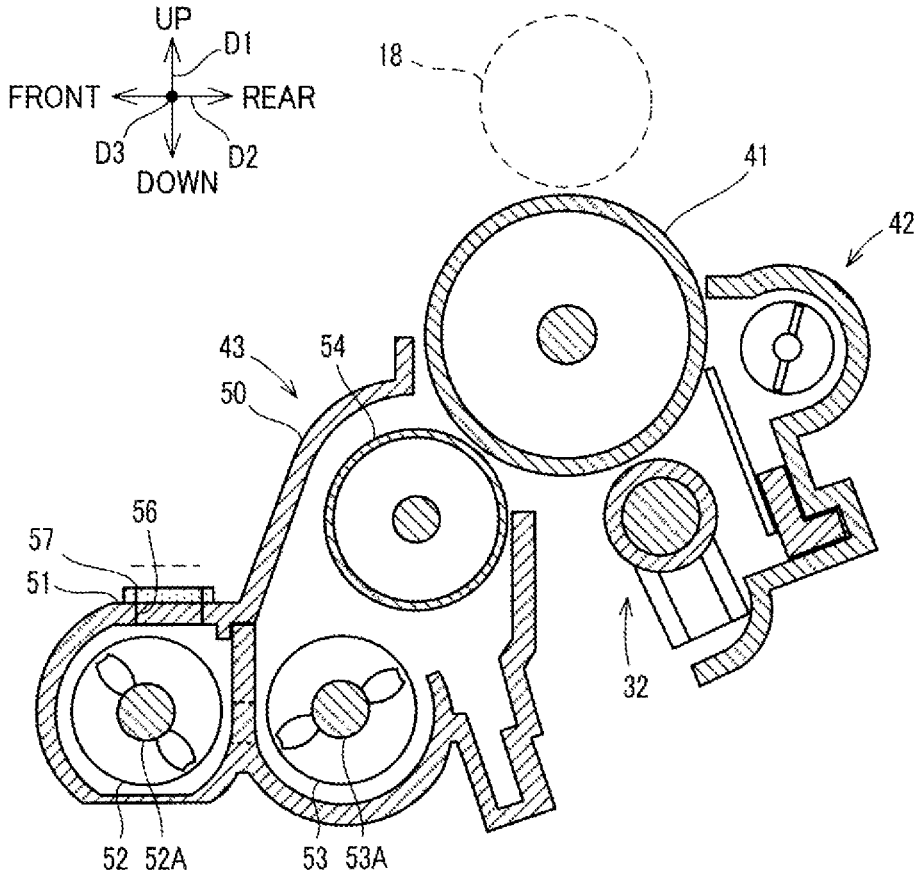
FIG. 2 is a diagram showing a configuration of an image forming unit included in the image forming apparatus.

FIG. 2 is a cross-sectional diagram of a central portion of the image forming unit 15, showing a configuration of the image forming unit 15. As shown in FIG. 2, each of the image forming units 15 includes a photoconductor drum 41, a drum cleaning device 42, a charging device 32, and a developing device 43 (an example of the toner storage case of the present disclosure). It is noted that in FIG. 1, some reference signs "32" and "42" are omitted for want of space.

The photoconductor drum 41 has a cylindrical shape and carries a toner image that is developed by the developing device 43. The photoconductor drum 41 is rotatably supported by the housing 11 or the like.

In each of the image forming units 15, the charging device 32 uniformly charges the photoconductor drum 41 to a certain potential. Subsequently, the laser scanning unit 17 irradiates a laser beam on the surfaces of the photoconductor drums 41 based on the image data. In this processing, electrostatic latent images are formed on the respective surfaces of the photoconductor drums 41. The electrostatic latent images are developed (visualized) by the developing devices 43 as the toner images. The toner images of the respective colors on the surfaces of the photoconductor drums 41 are sequentially transferred to the transfer belt 161 by the primary transfer rollers 18 to be overlaid with each other thereon. This allows a color toner image to be formed on the transfer belt 161. Next, the color image on the transfer belt 161 is transferred by the secondary transfer roller 19 to a print sheet (sheet member). The color image transferred to the print sheet is fixed to the print sheet by the fixing device 20, and thereafter, the print sheet is discharged from a sheet discharge port 28 to the sheet tray 21.

Each of the developing devices 43 performs a developing process of forming a toner image on the surface of the photoconductor drum 41 by adhering toner to the electrostatic latent image on the surface of the photoconductor drum 41 to develop it. Each of the developing device 43 is attached to the inside of the housing 11 in a detachable manner, and if the developing device 43 malfunctions or comes to the end of the service life, the developing device 43 is replaced with a new one.

Each of the developing devices 43 includes a housing 50, a first stirring member 52, a second stirring member 53, and a developing roller 54. Toner (developer) is stored in a bottom portion of the housing 50. The first stirring member 52 includes a rotary shaft 52A, and the second stirring member 53 includes a rotary shaft 53A. Each of the first stirring member 52 and the second stirring member 53 is a spiral member having a spiral blade around the rotary shaft 52A or the rotary shaft 53A, and is rotatably supported in the housing 50. Each of the first stirring member 52 and the second stirring member 53 is configured to, upon receiving a rotational driving force transmitted thereto, rotate and thereby convey, while stirring, the toner in the housing 50 in a predetermined direction. Shaft end portions of the rotary shaft 52A of the first stirring member 52 and the rotary shaft 53A of the second stirring member 53 are rotatably supported by bearing portions that have cylindrical shaft holes, the bearing portions being provided in side walls of the housing 50 that are opposite to each other in the left-right direction D3.

A replenishment port 56 (an opening) is formed in a wall 51 of the housing 50, wherein the wall 51 is located above the first stirring member 52. The replenishment port 56 includes a shutter 57 (an opening and closing member) for opening and closing the replenishment port 56. When the developing device 43 is attached to the housing 11, the shutter 57 is moved from a closing position for closing the replenishment port 56 to an opening position for opening the replenishment port 56. When the developing device 43 is removed from the housing 11, the shutter 57 moves from the opening position to the closing position to close the replenishment port 56.

As shown in FIG. 1, a plurality of toner containers 3 (3Y, 3C, 3M and 3K) are attached to the image forming apparatus 10. In the present embodiment, four toner containers 3 are attached, in a detachable manner, to the container attachment portion 30 which is provided in the housing 11. In addition, the four toner containers 3 are attached to the container attachment portion 30 in a state of being aligned along the front-rear direction D2, wherein a toner container 3K for black is disposed at the rear-most position.

As shown in FIG. 1, the container attachment portion 30 is provided above the intermediate transfer unit 16. The housing 11 has a storage space 25 between the intermediate transfer unit 16 and the sheet tray 21, and the container attachment portion 30 is provided in the storage space 25.

The container attachment portion 30 is fixed to an inner frame of the housing 11. The container attachment portion 30 is configured such that a plurality of toner containers 3 are attached thereto in a detachable manner. That is, the toner containers 3 are attached to the image forming apparatus 10 in a detachable manner through the container attachment portion 30. The container attachment portion 30 includes four storage rooms 31 configured to store the toner containers 3 of the respective colors. The toner containers 3 are respectively supported by the storage rooms 31 of the container attachment portion 30 in such a way as to be slidable in the left-right direction D3.

In a bottom surface of each of the storage rooms 31 located on the depth side, an inlet (not shown) is provided in such a way as to receive the toner supplied from the toner container 3. When the toner container 3 is attached to the storage room 31, a toner discharge port 63A (see FIG. 4) of the toner container 3 is positioned to the inlet so that the toner can be supplied from the toner discharge port 63A to the inlet.

[Toner Container 3]

The following describes a configuration of the toner container 3 with reference to FIG. 3 to FIG. 10.

The toner container 3 stores the toner that is supplied to the developing device 43. The toner container 3 is configured to be attachable to and detachable from the container attachment portion 30. The toner container 3 is supported by the container attachment portion 30 in such a way as to be slidable in an insertion/removal direction along the left-right direction D3 so that it can be inserted in and removed from the container attachment portion 30. The toner containers 3 are respectively inserted in the storage rooms 31 of the container attachment portion 30 from openings formed in the right side surface of the housing 11, and are attached to the storage rooms 31 of the container attachment portion 30.

It is noted that the toner container 3K storing black toner is formed to have a larger capacity than the other toner containers 3 (3Y, 3C and 3M). As a result, the toner container 3K for black is different in shape from the other toner containers 3 (3Y, 3C and 3M), but except for this, they have the same configuration.

Figure 3:
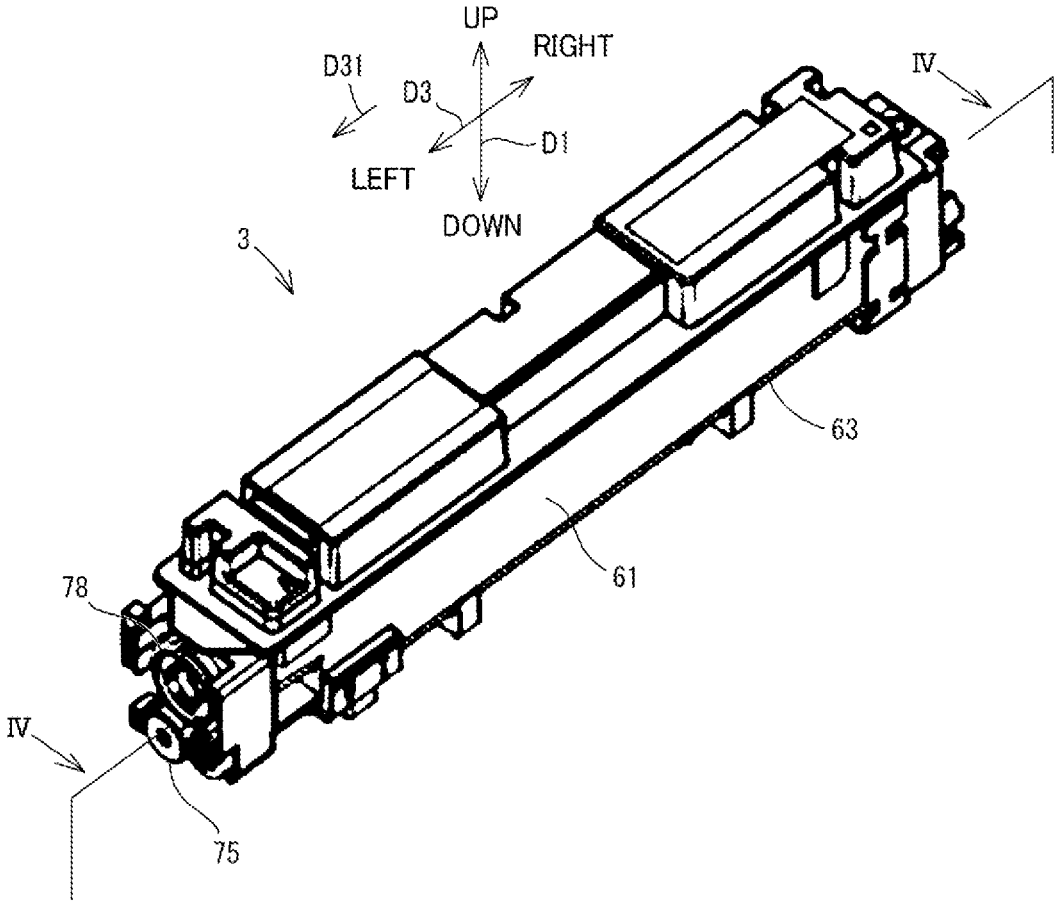
FIG. 3 is a perspective diagram showing the toner container.

FIG. 3 is a perspective diagram showing the toner container 3. As shown in FIG. 3, the toner container 3 includes a case main body 61 (an example of a case main body of the present disclosure) that is formed to be elongated in the left-right direction D3. It is noted that in FIG. 3, the up-down direction D1, the front-rear direction D2, and the left-right direction D3 are defined based on the state where the toner container 3 is attached to the container attachment portion 30.

The case main body 61 is a housing of the toner container 3, and is made from, for example, synthetic resin such as ABS resin or PET resin. The case main body 61 is configured to store the toner in an inside thereof. The case main body 61 is formed in an approximately parallelepiped shape elongated in the left-right direction D3. The toner that is used in the developing process by the developing device 43 is stored in the inside of the case main body 61.

The case main body 61 includes a bottom surface 63 that is supported by a bottom plate 34 of the container attachment portion 30. The toner discharge port 63A (an example of a toner discharge port of the present disclosure, see FIG. 4) is formed in the bottom surface 63 of the toner container 3, wherein the toner is discharged (flown out) from the inside to the outside through the toner discharge port 63A. In addition, the bottom surface 63 is provided with a shutter member 62 (see FIG. 4) configured to open and close the toner discharge port 63A.

The toner discharge port 63A is a through opening passing through a bottom plate of the case main body 61 in the up-down direction D1. The toner discharge port 63A is disposed in the vicinity of the right end portion of the bottom surface 63. The toner discharge port 63A is an opening (a supply port) through which the toner stored in the toner container 3 is supplied to the developing device 43 when the toner container 3 is attached to the attachment position of the container attachment portion 30.

Figure 4:
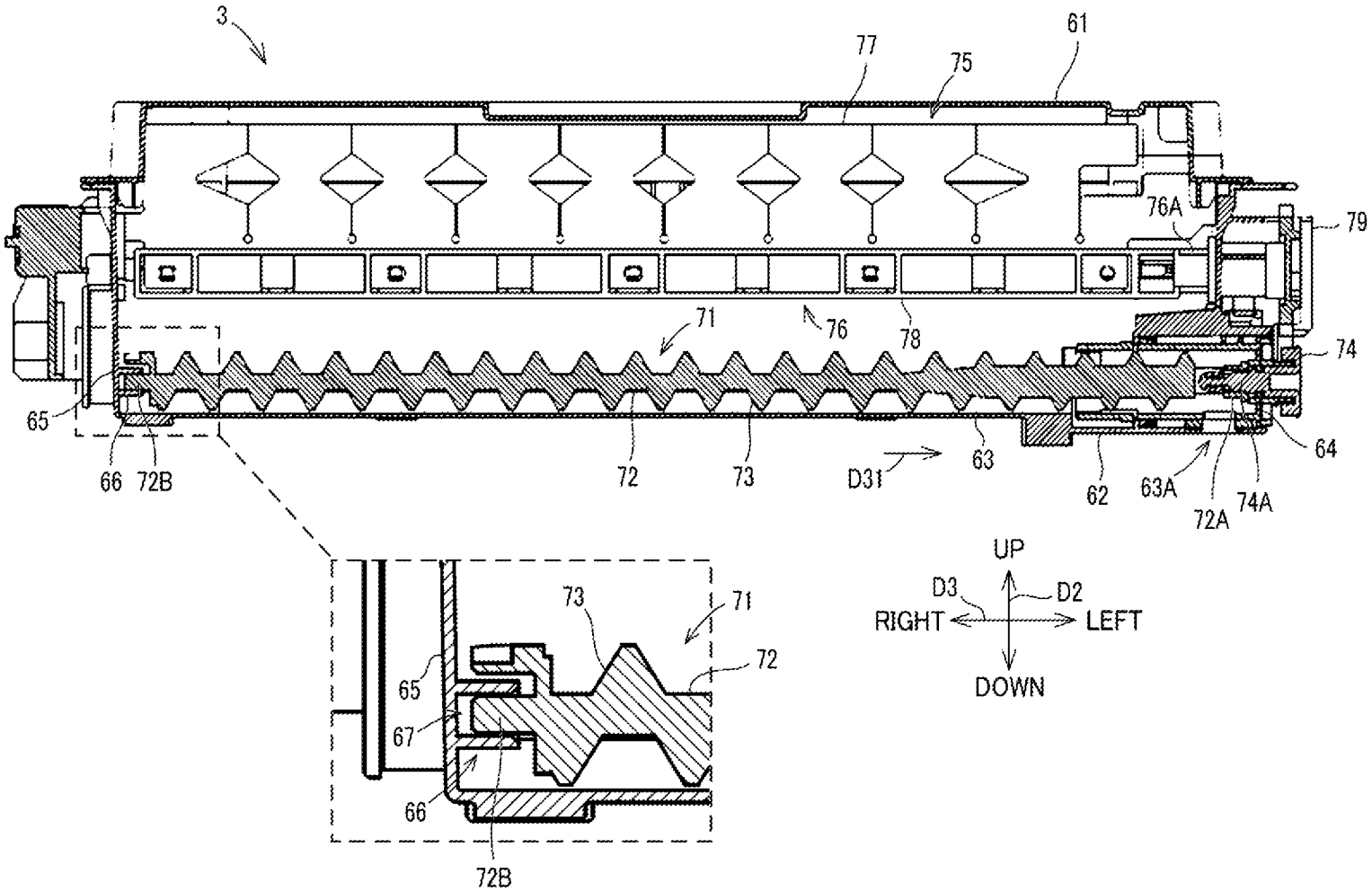
FIG. 4 is a cross-sectional diagram of the toner container taken along a vertical cut plane IV-IV that includes a rotation center line of a conveyance member.

As shown in FIG. 4, the toner container 3 includes a conveyance member 71 (an example of a rotary member of the present disclosure). FIG. 4 is a cross-sectional diagram of the toner container 3 taken along a vertical cut plane IV-IV (see FIG. 3) that includes the rotation center line of the conveyance member 71. In FIG. 4, a detailed enlarged diagram of the right end portion of the conveyance member 71 is provided. The conveyance member 71 is configured to convey the toner toward the toner discharge port 63A, and is rotatably provided inside the case main body 61.

The conveyance member 71 moves the toner in the case main body 61 by being rotated. Specifically, by being rotated, the conveyance member 71 conveys the toner in a conveyance direction D31 (see FIG. 4) toward the toner discharge port 63A. The conveyance member 71 is disposed in a bottom portion of the case main body 61. The bottom portion of the case main body 61 is formed in an arc shape corresponding to the rotary locus of a spiral blade 73 included in the conveyance member 71.

The conveyance member 71 is formed to be elongated in the longitudinal direction of the case main body 61. The conveyance member 71 includes a rotary shaft 72 and the spiral blade 73 that extends in the axial direction of the rotary shaft 72. The spiral blade 73 has a spiral shape that continues along the axial direction of the rotary shaft 72. That is, the conveyance member 71 is a spiral member in which the blade (spiral blade) 73 of the spiral shape is provided on the rotary shaft 72. When the conveyance member 71 is rotated, a side surface of the spiral blade 73 presses the toner in the conveyance direction D31, and thereby the toner is conveyed toward the toner discharge port 63A.

Opposite end portions of the rotary shaft 72 of the conveyance member 71 opposite in the width direction D3 are rotatably supported by opposite side walls of the case main body 61 opposite in the width direction D3. A left side wall 64 of the case main body 61 is provided with a shaft joint 74 configured to transmit a rotational driving force to the conveyance member 71. The shaft joint 74 is rotatably supported by the left side wall 64. In the state where the toner container 3 is attached to the container attachment portion 30, the shaft joint 74 is coupled with a drive transmission portion, such as a motor, of the image forming apparatus 10. This allows the rotational driving force to be input from the drive transmission portion to the conveyance member 71 via the shaft joint 74.

The shaft joint 74 includes a protruding shaft 74A that passes through the left side wall 64 to extend into the case main body 61. The protruding shaft 74A is inserted in an insertion hole that is formed in a shaft end portion 72A of the rotary shaft 72 of the conveyance member 71, wherein the shaft end portion 72A is provided at one side (left side) of the rotary shaft 72. In the state where the protruding shaft 74A is inserted in the insertion hole, the shaft end portion 72A is rotatably supported.

A bearing portion 66 (an example of a bearing portion of the present disclosure) is provided at a right side wall 65 of the case main body 61. The bearing portion 66 rotatably supports a shaft end portion 72B (an example of a support shaft portion of the present disclosure) that is provided at the other side (right side) of the rotary shaft 72 of the conveyance member 71. The shaft end portion 72B is rotatably supported by the bearing portion 66. A bearing hole 67 is formed in the bearing portion 66 so as to rotatably support the shaft end portion 72B. In the state where the shaft end portion 72B is inserted in the bearing hole 67, the shaft end portion 72B is rotatably supported.

Figure 5:
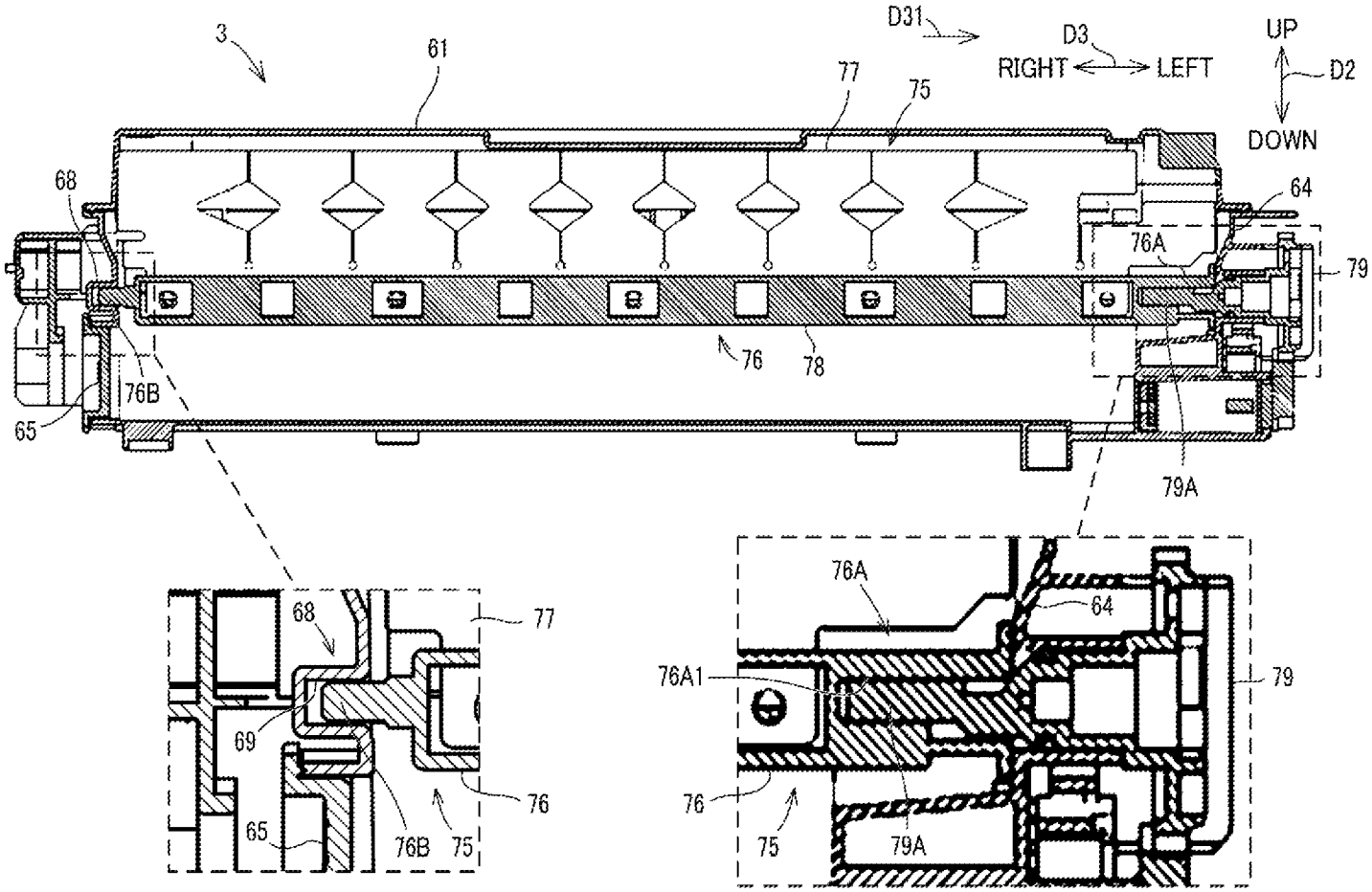
FIG. 5 is a cross-sectional diagram of the toner container taken along a vertical cut plane that includes a rotation center line of a stirring member.

As shown in FIG. 4 and FIG. 5, the toner container 3 includes a stirring member 75 (an example of a rotary member of the present disclosure). FIG. 5 is a cross-sectional diagram of the toner container 3 taken along a vertical cut plane that includes the rotation center line of the stirring member 75. In FIG. 5, detailed enlarged diagrams of opposite end portions of the stirring member 75 are provided. The stirring member 75 is configured to stir the toner in the case main body 61, and is rotatably provided inside the case main body 61.

The stirring member 75 moves the toner in the case main body 61 by being rotated. Specifically, by being rotated, the stirring member 75 moves the toner in a rotation direction of the stirring member 75 to stir the toner. The stirring member 75 is provided above the conveyance member 71 and disposed at approximately the center of the toner container 3 when viewed from the longitudinal direction of the toner container 3.

As shown in FIG. 5, the stirring member 75 is formed to be elongated in the longitudinal direction of the case main body 61. The stirring member 75 includes a rotary shaft 76 and a paddle member 77 that is attached to the rotary shaft 76. The paddle member 77 is formed in a paddle shape and is formed from an elastic material such as PET (polyethylene terephthalate) resin. Specifically, the paddle member 77 is a rectangular, thin film member.

The rotary shaft 76 is rotatably provided inside the toner container 3. The rotary shaft 76 includes a shaft main body 78, a bearing portion 76A (an example of the bearing portion of the present disclosure) and a shaft end portion 76B (an example of the support shaft portion of the present disclosure), wherein the shaft main body 78 holds the paddle member 77, the bearing portion 76A is provided in a left end portion of the shaft main body 78, and the shaft end portion 76B protrudes laterally from a right end portion of the shaft main body 78. Opposite end portions of the rotary shaft 76 opposite in its axial direction are rotatably supported by the bearing portion 76A and the shaft end portion 76B at opposite side walls of the case main body 61 opposite in the width direction D3, respectively.

A shaft joint 79 is provided at the left side wall 64 of the case main body 61, wherein the shaft joint 79 is configured to transmit a rotational driving force to the stirring member 75. The shaft joint 79 is rotatably supported by the left side wall 64. In the state where the toner container 3 is attached to the container attachment portion 30, the shaft joint 79 is coupled with a drive transmission portion, such as a motor, of the image forming apparatus 10. This allows the rotational driving force to be input from the drive transmission portion to the stirring member 75 via the shaft joint 79.

The shaft joint 79 includes a protruding shaft 79A (an example of the support shaft portion of the present disclosure) that passes through the left side wall 64 to extend into the case main body 61. The protruding shaft 79A is rotatably supported by the bearing portion 76A. The protruding shaft 79A is inserted in an insertion hole 76A1 that is formed in the bearing portion 76A, wherein the bearing portion 76A is provided at one side (left side) of the rotary shaft 76 of the stirring member 75. The insertion hole 76A1 rotatably supports the protruding shaft 79A. In the state where the protruding shaft 79A is inserted in the insertion hole 76A1, the left end portion of the rotary shaft 76 is rotatably supported.

A bearing portion 68 (an example of the bearing portion of the present disclosure) is provided at the right side wall 65. The bearing portion 68 rotatably supports the shaft end portion 76B that is provided at the other side (right side) of the stirring member 75. A bearing hole 69 is formed in the bearing portion 68 so as to rotatably support the shaft end portion 76B. In the state where the shaft end portion 76B is inserted in the bearing hole 69, the shaft end portion 76B is rotatably supported.

Meanwhile, in conventional developing devices and toner cases, a shaft end portion of a rotary shaft includes a discharge screw, and a discharge port is provided inside a bearing portion. Accordingly, the bearing portion has a complicated configuration, and it is not easy to mold a housing of the conventional developing devices and toner cases.

In addition, in the bearing portion 66 that pivotably supports the shaft end portion 72B of the conveyance member 71, if the toner enters a gap between the shaft end portion 72B and the bearing portion 66, the toner may be fused due to a rotary friction caused by the rotation of the shaft end portion 72B, and the shaft end portion 72B of the conveyance member 71 may be stuck. This problem may also occur to the shaft end portion 76B of the stirring member 75. On the other hand, in the toner container 3 of the present embodiment, a toner returning mechanism 80 (an example of a toner returning portion of the present disclosure) described below is provided. Accordingly, in a case where the toner has entered the gap between the shaft end portion 72B of the conveyance member 71 and the bearing portion 66, it is possible, with a simple configuration, to discharge the toner from the gap.

[Toner Returning Mechanism 80]

Figure 6:
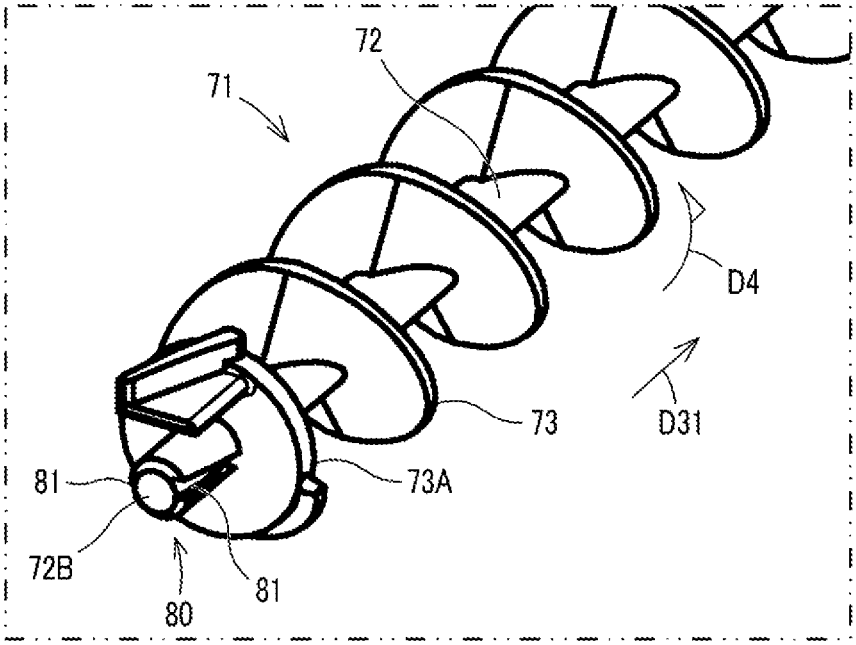
FIG. 6 is a partially enlarged diagram showing a configuration of a shaft end portion of the conveyance member.

The toner container 3 further includes the toner returning mechanism 80 (see FIG. 6). The toner returning mechanism 80 is configured to return the toner that has entered the bearing hole 67 of the bearing portion 66, to outside of the bearing hole 67. When the conveyance member 71 rotates, the toner returning mechanism 80 discharges the toner from the bearing portion 66 in a direction of returning it to the outside.

Figure 7:
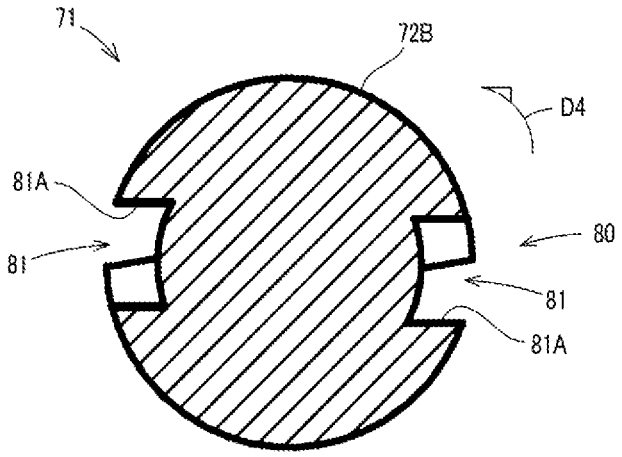
FIG. 7 is a cross-sectional diagram of the shaft end portion of the conveyance member.

The following describes an embodiment of the toner returning mechanism 80 with reference to FIG. 6 and FIG. 7. Here, FIG. 6 and FIG. 7 show the embodiment of the toner returning mechanism 80, wherein FIG. 6 is a partially enlarged diagram showing a configuration of the shaft end portion 72B of the rotary shaft 72 of the conveyance member 71, and FIG. 7 is a cross-sectional diagram of the shaft end portion 72B taken along a cut plane that is perpendicular to the axial direction.

As shown in FIG. 6, the toner returning mechanism 80 is composed of two inclined grooves 81 that are formed on an outer peripheral surface of the shaft end portion 72B of the conveyance member 71. The two inclined grooves 81 are arranged at equal intervals in the circumferential direction of the shaft end portion 72B. The shaft end portion 72B protrudes in the axial direction to the outside from a side surface of a disk member 73A provided at an end portion of the spiral blade 73 in the axial direction. The inclined grooves 81 extend on the outer peripheral surface of the shaft end portion 72B from the side surface of the disk member 73A to a tip of the shaft end portion 72B. The inclined grooves 81 are inclined with respect to the conveyance direction D31 so that the inclined grooves 81 can discharge the toner in the same direction as the conveyance direction D31 when the conveyance member 71 rotates in a rotation direction D4 to convey the toner in the conveyance direction D31. With this configuration, when the conveyance member 71 rotates in the rotation direction D4, the inclined grooves 81 scrape off the toner that has entered a gap between the outer peripheral surface of the shaft end portion 72B and the inner peripheral surface of the bearing hole 67 to guide the toner into the grooves, and the toner in the grooves (the scraped-off toner) is pressed in the conveyance direction D31 by inner side surfaces 81A (see FIG. 7) that are provided inside the inclined grooves 81 on an upstream side in the rotation direction D4, thereby the toner is discharged to the outside from the bearing hole 67 of the bearing portion 66.

With the configuration where the inclined grooves 81 are provided on the outer peripheral surface of the shaft end portion 72B, it is possible to discharge the toner that has entered the gap between the outer peripheral surface of the shaft end portion 72B and the inner peripheral surface of the bearing hole 67, to the outside from the gap. As a result of this, the toner hardly accumulates in the bearing hole 67, and it is possible to prevent a rotation failure or a lock of the rotary shaft 72 from occurring due to a fusion or an aggregation of the toner. In addition, the above-mentioned advantageous effect is produced only by providing the inclined grooves 81 only on the shaft end portion 72B, and it is possible, with a simple configuration, to prevent malfunctions such as the rotation failure and the lock.

It is noted that the inclined grooves 81 may be straight grooves that extend straight, or formed in an arc shape or a spiral shape. In addition, it is sufficient that one or more inclined grooves 81 are formed on the outer peripheral surface of the shaft end portion 72B. It is noted that when a plurality of inclined grooves 81 are provided, the inclined grooves 81 are arranged at equal intervals in the circumferential direction of the shaft end portion 72B. In addition, the inclined grooves 81 may be one spiral groove of a spiral shape formed on the outer peripheral surface of the shaft end portion 72B of the conveyance member 71.

Next, a modification example of the toner returning mechanism 80 is described with reference to FIG. 8 and FIG. 9. Here, FIG. 8 and FIG. 9 show a modification example of the toner returning mechanism 80, wherein FIG. 8 is a partially enlarged diagram showing a configuration of the shaft end portion 72B of the rotary shaft 72 of the conveyance member 71, and FIG. 9 is a cross-sectional diagram of the shaft end portion 72B taken along a cut plane that is perpendicular to the axial direction.

Figure 8:
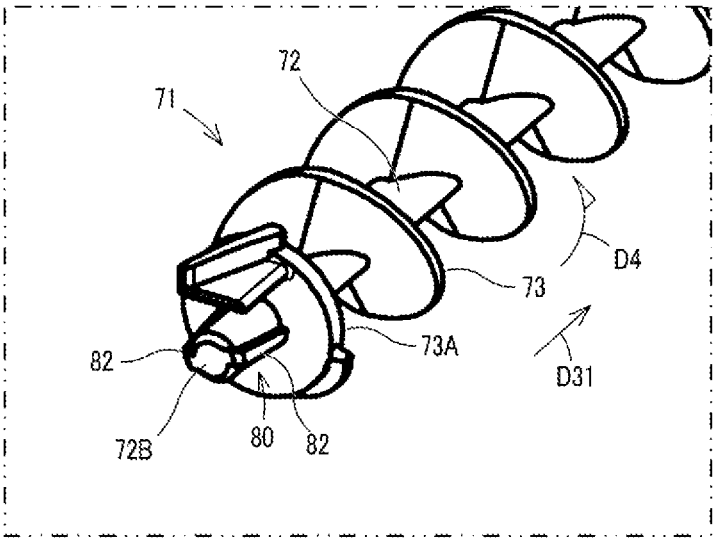
FIG. 8 is a partially enlarged diagram showing a configuration of a modification example of the shaft end portion of the conveyance member.
Figure 9:
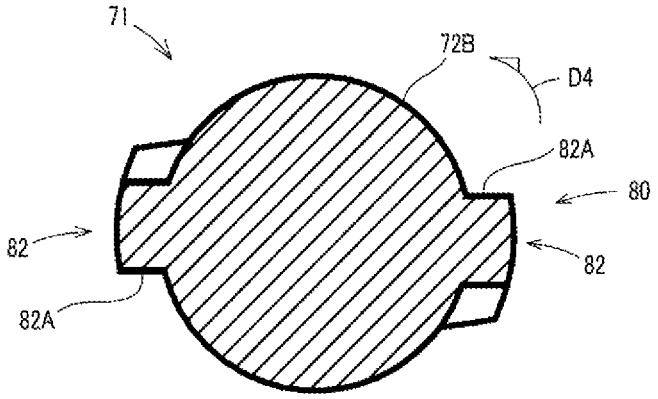
FIG. 9 is a cross-sectional diagram showing a configuration of the modification example of the shaft end portion of the conveyance member.

As shown in FIG. 8, the toner returning mechanism 80 is composed of two inclined ribs 82 that are formed on an outer peripheral surface of the shaft end portion 72B of the conveyance member 71. The two inclined ribs 82 are arranged at equal intervals in the circumferential direction of the shaft end portion 72B. The shaft end portion 72B including the two inclined ribs 82 is inserted in the bearing hole 67 so that the shaft is rotatably supported. The shaft end portion 72B protrudes in the axial direction to the outside from the side surface of the disk member 73A provided at an end portion of the spiral blade 73 in the axial direction. The inclined ribs 82 extend on the outer peripheral surface of the shaft end portion 72B from the side surface of the disk member 73A to the tip of the shaft end portion 72B. The inclined ribs 82 are inclined with respect to the conveyance direction D31 so that the inclined ribs 82 can discharge the toner in the same direction as the conveyance direction D31 when the conveyance member 71 rotates in the rotation direction D4 to convey the toner in the conveyance direction D31. With this configuration, when the conveyance member 71 rotates in the rotation direction D4, the inclined ribs 82 scrape off the toner that has entered a gap between the outer peripheral surface of the shaft end portion 72B and the inner peripheral surface of the bearing hole 67, and the toner (the scraped-off toner) is pressed in the conveyance direction D31 by side surfaces 82A (see FIG. 8) of the inclined ribs 82 that are on a downstream side in the rotation direction D4, thereby the toner is discharged to the outside from the bearing hole 67 of the bearing portion 66.

With the configuration where the inclined ribs 82 are provided on the outer peripheral surface of the shaft end portion 72B, it is possible to discharge the toner that has entered the gap between the outer peripheral surface of the shaft end portion 72B and the inner peripheral surface of the bearing hole 67, to the outside from the gap. As a result of this, the toner hardly accumulates in the bearing hole 67, and it is possible to prevent a rotation failure or a lock of the rotary shaft 72 from occurring due to a fusion or an aggregation of the toner. In addition, the above-mentioned advantageous effect is produced only by providing the inclined ribs 82 only on the shaft end portion 72B, and it is possible, with a simple configuration, to prevent malfunctions such as the rotation failure and the lock.

It is noted that the inclined ribs 82 may be straight ribs that extend straight, or formed in an arc shape or a spiral shape. In addition, it is sufficient that one or more inclined ribs 82 are formed on the outer peripheral surface of the shaft end portion 72B. It is noted that when a plurality of inclined ribs 82 are provided, the inclined ribs 82 are arranged at equal intervals in the circumferential direction of the shaft end portion 72B. In addition, the inclined ribs 82 may be one spiral rib of a spiral shape formed on the outer peripheral surface of the shaft end portion 72B of the conveyance member 71.

Next, another modification example of the toner returning mechanism 80 is described with reference to FIG. 10. Here, FIG. 10, showing the other modification example of the toner returning mechanism 80, is a cross-sectional diagram of the shaft end portion 72B taken along a vertical cut plane that includes the shaft center line.

Figure 10:
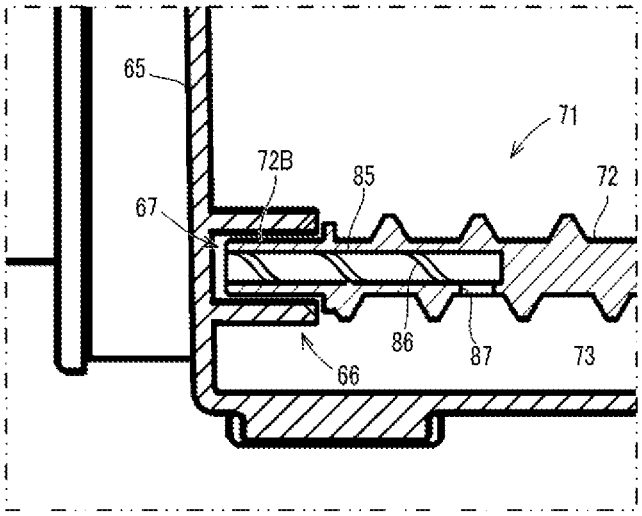
FIG. 10 is a cross-sectional diagram showing a configuration of another modification example of the shaft end portion of the conveyance member.

As shown in FIG. 10, an inner hole 85 is formed in the rotary shaft 72. The inner hole 85 is a tubular hole bored from a tip end surface of the shaft end portion 72B of the conveyance member 71 toward the inside of the rotary shaft 72. The boring depth of the inner hole 85 only needs to be equal to or larger than the length of the shaft end portion 72B. In this modification example, the toner returning mechanism 80 is a spiral groove 86 that is formed on the inner peripheral surface of the inner hole 85. The spiral groove 86 is formed in a spiral shape along the axial direction of the rotary shaft 72 so that the toner that has entered the inner hole 85 is conveyed in the same direction as the conveyance direction D31 through the inside of the inner hole 85. With this configuration, when the conveyance member 71 rotates in the rotation direction D4 to convey the toner in the conveyance direction D31, the spiral groove 86 causes the toner that has entered the gap between the outer peripheral surface of the shaft end portion 72B and the inner peripheral surface of the bearing hole 67 and further has entered the inner hole 85, to move in the same direction as the conveyance direction D31.

In addition, a through hole 87 that passes through to the inner hole 85 is formed in the rotary shaft 72. The through hole 87 is configured to discharge the toner that is conveyed in the inner hole 85 in the conveyance direction D31 by the spiral groove 86, to the outside of the rotary shaft 72 from the inner hole 85.

With the configuration where the spiral groove 86 is formed in the inner hole 85 of the rotary shaft 72, the spiral groove 86 causes the toner that has entered the gap between the outer peripheral surface of the shaft end portion 72B and the inner peripheral surface of the bearing hole 67 and further has entered the inner hole 85, to move in the same direction as the conveyance direction D31. As a result of this, the toner hardly accumulates in the bearing hole 67, and it is possible to prevent a rotation failure or a lock of the rotary shaft 72 from occurring due to a fusion or an aggregation of the toner. In addition, the above-mentioned advantageous effect is produced only by providing the inner hole 85 and the spiral groove 86 only in the rotary shaft 72, and it is possible, with a simple configuration, to prevent malfunctions such as the rotation failure and the lock.

It is noted that, in place of the spiral groove 86, one or more inclined grooves may be formed on the inner peripheral surface of the inner hole 85. In addition, in place of the spiral groove 86, a spiral rib formed in a spiral shape along the axial direction of the rotary shaft 72, or one or more inclined ribs may be formed on the inner peripheral surface of the inner hole 85. In addition, the shaft end portion 72B of the rotary shaft 72 may be provided with not only the spiral groove 86 formed on the inner peripheral surface of the inner hole 85, but also the inclined grooves 81 (see FIG. 6) or the inclined ribs 82 (see FIG. 8) formed on its outer peripheral surface.

In the above-described embodiment, the toner returning mechanism 80 is provided in the shaft end portion 72B of the rotary shaft 72 of the conveyance member 71. However, not limited to the configuration, the toner returning mechanism 80 may be provided in the shaft end portion 72A that is on the opposite side to the shaft end portion 72B. In addition, the toner returning mechanism 80 may be provided in the protruding shaft 79A that rotatably supports the rotary shaft 76 of the stirring member 75, or in the shaft end portion 76B.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner storage case comprising:

a case main body in which toner is stored;

a rotary member provided in the case main body and configured to move the toner by being rotated;

a support shaft portion rotatably supporting the rotary member;

a bearing portion including a bearing hole that rotatably supports the support shaft portion in a state where the support shaft portion is inserted in the bearing hole; and a toner returning portion provided on an outer peripheral surface of the support shaft portion and configured to return the toner that has entered the bearing hole, in an outward direction toward an outside of the bearing hole as the rotary member is rotated, wherein the toner returning portion is composed of a plurality of inclined grooves or a plurality of inclined ribs that are formed on the outer peripheral surface of the support shaft portion and configured to move, in the outward direction, the toner that has entered a gap between the outer peripheral surface and the bearing hole, and the plurality of inclined grooves or the plurality of inclined ribs are arranged at equal intervals in a circumferential direction of the support shaft portion.

2. The toner storage case according to claim 1, wherein the rotary member is a stirring member configured to stir the toner in the case main body by being rotated.

3. The toner storage case according to claim 1, wherein the case main body includes a toner discharge port in a bottom surface thereof, and the rotary member is a conveyance member that, by being rotated, conveys the toner in the case main body toward the toner discharge port.

4. An image forming apparatus comprising:

the toner storage case according to claim 1, wherein the image forming apparatus forms an image on a sheet member by using the toner stored in the toner storage case.

5. A toner storage case comprising:

a case main body in which toner is stored;

a rotary member provided in the case main body and configured to move the toner by being rotated;

a support shaft portion rotatably supporting the rotary member;

a bearing portion including a bearing hole that rotatably supports the support shaft portion in a state where the support shaft portion is inserted in the bearing hole; and a toner returning portion provided on an outer peripheral surface of the support shaft portion and configured to return the toner that has entered the bearing hole, in an outward direction toward an outside of the bearing hole as the rotary member is rotated, wherein the support shaft portion includes an inner hole that is bored from an end surface of the support shaft portion in an axial direction of the support shaft portion toward an inside of the support shaft portion, and the toner returning portion is an inclined groove or an inclined rib that is formed on an inner peripheral surface of the inner hole and configured to move, in the outward direction, the toner that has entered the inner hole.

6. The toner storage case according to claim 5, wherein the support shaft portion includes a through hole that passes through from the outer peripheral surface of the support shaft portion to the inner hole, and is configured to discharge the toner from the inner hole to outside the support shaft portion.

7. An image forming apparatus comprising:

the toner storage case according to claim 5, wherein the image forming apparatus forms an image on a sheet member by using the toner stored in the toner storage case.

* * * * *